US009169035B2

(12) United States Patent
Tanaka et al.

(10) Patent No.: US 9,169,035 B2
(45) Date of Patent: Oct. 27, 2015

(54) BOTTLE

(75) Inventors: Toshimasa Tanaka, Tokyo (JP); Toyoji Kato, Matsudo (JP); Masaaki Sasaki, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 35 days.

(21) Appl. No.: 12/734,132

(22) PCT Filed: Oct. 15, 2008

(86) PCT No.: PCT/JP2008/068631

§ 371 (c)(1),
(2), (4) Date: Apr. 13, 2010

(87) PCT Pub. No.: WO2009/051129

PCT Pub. Date: Apr. 23, 2009

(65) Prior Publication Data

US 2010/0206839 A1 Aug. 19, 2010

(30) Foreign Application Priority Data

Oct. 17, 2007 (JP) ..... 2007-270383

(51) Int. Cl.

| | |
|---|---|
| ***B65D 90/02*** | (2006.01) |
| ***B65D 1/02*** | (2006.01) |
| ***B65D 1/44*** | (2006.01) |
| ***B65D 79/00*** | (2006.01) |

(52) U.S. Cl.

CPC ..... *B65D 1/0223* (2013.01); *B65D 1/44* (2013.01); *B65D 79/005* (2013.01); *B65D 2501/0036* (2013.01)

(58) Field of Classification Search

CPC ..... B65D 1/0223; B65D 2501/0036; B65D 2501/0081; B65D 2501/0027; B65D 79/005

USPC ..... 215/381–384, 386, 390, 395; 220/669, 220/670, 675, 770; D9/516–519

See application file for complete search history.

(56) References Cited

U.S. PATENT DOCUMENTS

| | | | | |
|---|---|---|---|---|
| 3,225,950 | A * | 12/1965 | Fulcher et al. | 215/384 |
| 5,238,129 | A * | 8/1993 | Ota | 215/381 |
| 5,337,909 | A * | 8/1994 | Vailliencourt | 215/381 |
| 6,062,409 | A | 5/2000 | Eberle | |
| 6,347,717 | B1 | 2/2002 | Eberle | |

(Continued)

FOREIGN PATENT DOCUMENTS

| | | |
|---|---|---|
| JP | U-62-177613 | 11/1987 |
| JP | A-2002-513720 | 5/2002 |

(Continued)

OTHER PUBLICATIONS

International Search Report issued in International Patent Application No. PCT/JP2008/068631 on Jan. 20, 2009 (with Translation).

(Continued)

*Primary Examiner* — Fenn Mathew
*Assistant Examiner* — Cynthia Collado
(74) *Attorney, Agent, or Firm* — Oliff PLC

(57) ABSTRACT

According to a bottle of the present invention, grooves are formed at each of an upper and a lower end portions of a column; the grooves extend along a circumferential direction; both end portions of each of the grooves in the circumferential direction are in contact with each of both end edges of the column in the circumferential direction, whereby occurrence of local deformation in the column can be suppressed.

2 Claims, 2 Drawing Sheets

(56) References Cited

U.S. PATENT DOCUMENTS

| | | | | |
|---|---|---|---|---|
| 6,349,838 | B1 * | 2/2002 | Saito et al. | 215/371 |
| 6,938,788 | B2 * | 9/2005 | White | 215/384 |
| 7,748,551 | B2 * | 7/2010 | Gatewood et al. | 215/381 |
| 2004/0164047 | A1 * | 8/2004 | White | 215/384 |
| 2005/0218108 | A1 * | 10/2005 | Bangi et al. | 215/384 |
| 2010/0320218 | A1 * | 12/2010 | Tanaka | 220/721 |
| 2013/0082024 | A1 * | 4/2013 | Howell et al. | 215/381 |
| 2014/0166609 | A1 * | 6/2014 | Yourist | 215/383 |

FOREIGN PATENT DOCUMENTS

| | | | | |
|---|---|---|---|---|
| JP | A-2002-293315 | | 10/2002 | |
| JP | A-2002-332022 | | 11/2002 | |
| JP | A-2003-063516 | | 3/2003 | |
| JP | A-2005-313971 | | 11/2005 | |
| JP | 2004352332 | A * | 11/2006 | 215/383 |
| JP | A-2006-321522 | | 11/2006 | |
| WO | WO 97/34808 | | 9/1997 | |

OTHER PUBLICATIONS

May 16, 2012 Search Report issued in European Patent Application No. 08840708.5.

Jul. 3, 2013 Office Action issued in related Chinese Application No. 200880109963.8.

* cited by examiner

BOTTLE

TECHNICAL FIELD

The present invention relates to a bottle formed of, for example, a synthetic resin. The present application claims priority based on Japanese Patent Application No. 2007-270383 filed in Japan on Oct. 17, 2007, and its content is cited herein.

BACKGROUND ART

As this type of bottles, a bottle is well known in which a tube-like body part having a bottom, a shoulder part and an opening part are integrally formed of a synthetic resin, and panels recessed inwardly in a radial direction are provided to the body part at intervals in a circumferential direction of the bottle. These panels provided to the body part suppress the occurrence of appearance defects caused by swelling deformation when the bottle is filled with high temperature contents, or collapsing deformation when a temperature of the contents contained in the bottle is decreased (see, for example, Patent Document 1).

[Patent Document 1] Japanese Patent Application Laid-open No. 2003-63516

DISCLOSURE OF INVENTION

Problem to be Solved by the Invention

However, with the conventional bottle above, the following problem remains. That is, when a large number of bottles are consecutively delivered on the same line, a column formed between the panels adjacent to each other in a circumferential direction is locally dented inwardly in a radial direction due to an effect of line pressure, and there are cases where this dent is not recovered. Additionally, when the bottle is filled with high temperature contents, the column may be largely deformed in an expansion form. After this, there may be a case where this deformation is not recovered even after the inside of the bottle becomes depressurized. The deformations as described above are more likely to occur especially at an end portion of the column in a central axis direction of the body part.

To solve the problem described above, an object of the present invention is to provide a bottle in which the occurrence of local deformation in the column is suppressed.

Means for Solving the Problem

To solve the problem described above, the present invention employs the following means. A bottle according to the present invention relates to a bottle in which panels recessed inwardly toward a radial direction are formed at intervals in a circumferential direction of a tube-like body part having a bottom, and a space between the panels adjacent to each other in the circumferential direction is designed as a column. In the bottle according to the present invention, a groove is formed at one or both end portions of the column in a central axis direction of the body part, the groove extending along the circumferential direction, and both end portions of the groove in the circumferential direction being respectively in contact with both end edges of the column in the circumferential direction.

According to the present invention, by forming, at the column, the groove recessed inwardly in the radial direction, the column is less likely to deform in the radial direction of the bottle. Also, by forming the groove at both end portions of the column in the central axis direction, the deformation of the column in the radial direction can be suppressed. Additionally, by forming the groove at the end portion of the column throughout its entire length in the circumferential direction, the entire range of the end portion of the column can be reinforced, so that an occurrence of the local deformation in the column can be reliably suppressed. Furthermore, the groove is in contact with both end edges of the column in the circumferential direction, and is not formed within the panel. Hence, the deformation of the groove following the deformation of the panel can be suppressed.

Additionally, in the bottle according to the present invention, it is preferable that the groove is formed at the lower end portion of the column.

With this bottle, as compared with the upper portion of the bottle, the lower end portion of the column is more likely to be formed with a thin wall, and thus is more likely to largely deform. Thus, by forming the groove in the lower end portion of the column, the occurrence of the local deformation in the column can be reliably suppressed.

Additionally, in the bottle according to the present invention, it is preferable to form the groove at each of the upper and lower ends of the column.

In this case, the column is less likely to deform in the radial direction of the bottle, so that the occurrence of the local deformation in the column can be suppressed.

Additionally, in the bottle according to the present invention, it is preferable that the groove has a bottom part and a pair of inclined parts. In the pair of inclined parts, as they extend from both end portions of the bottom part in the central axis direction toward the outside direction away from the central axis direction, the amount of inward recession in the radial direction decreases.

In this case, by forming the inclined parts in the groove, the stress applied to the groove can be effectively distributed, and the die cutting at the time of bottle molding becomes easy.

Effect of the Invention

According to the present invention, the groove makes the column less likely to deform in the radial direction, so that an occurrence of local deformation in the column can be suppressed. Additionally, the groove is not formed such that it reaches the inside of the panel, whereby the deformation of the groove accompanying the deformation of the panel can be prevented.

DESCRIPTION OF SYMBOLS

1 Bottle
11 Panel
12 Column
22, 23 Groove
22*a*, 23*a* Bottom part
22*b*, 22*c*, 23*b*, 23*c* Inclined part
O Central axis

BEST MODE FOR CARRYING OUT THE INVENTION

Next, one embodiment of a bottle according to the present invention is described with reference to FIGS. 1 and 2. In each figure, the size of each member is changed as appropriate to make each member recognizable.

Embodiment

Figure 1:
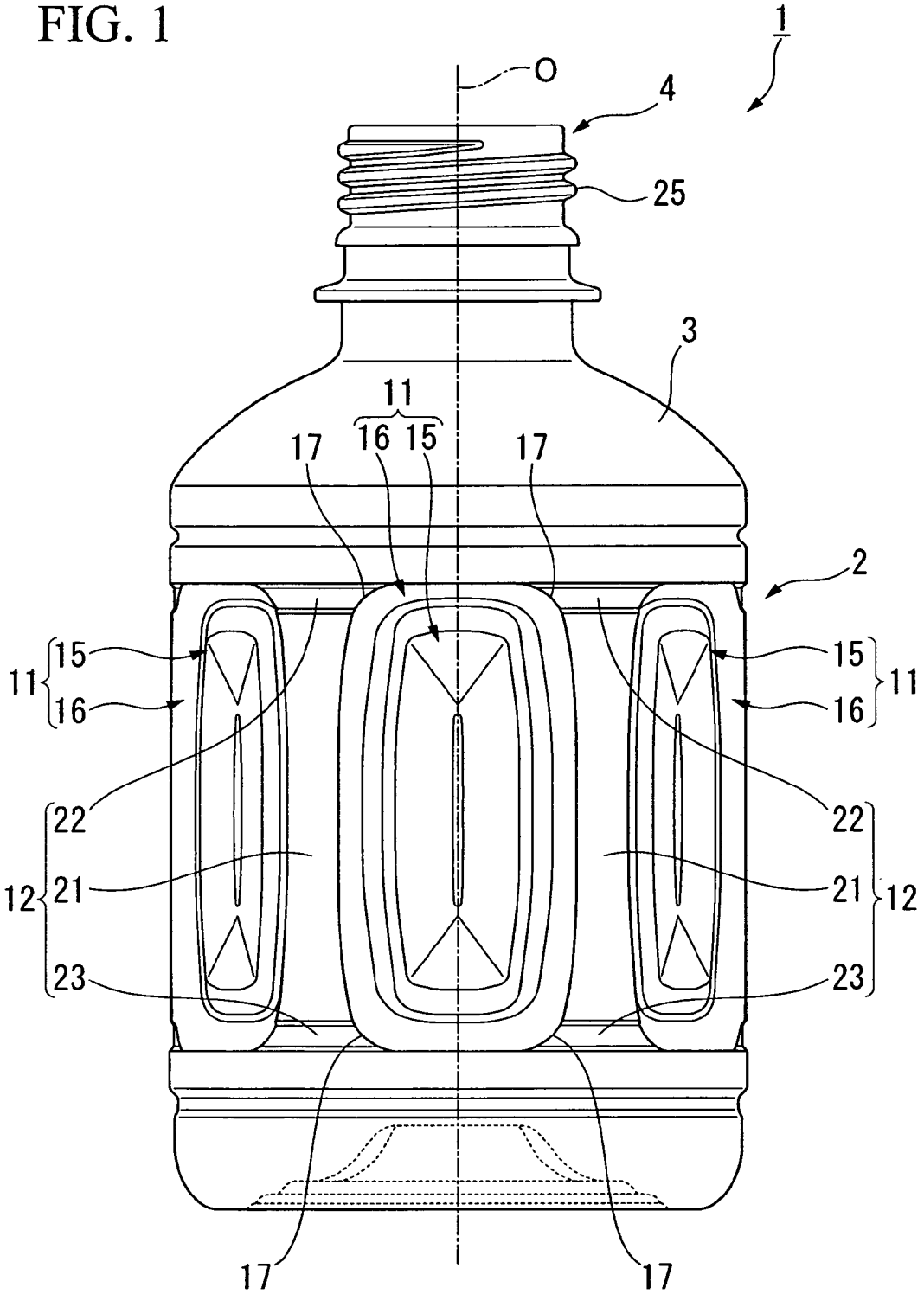
FIG. 1 is a side view illustrating a bottle of the present invention.

As shown in FIG. 1, a bottle 1 in this embodiment is formed of a synthetic resin such as PET (polyethylene terephthalate), and has a body part 2, a shoulder part 3, and an opening part 4. The body part 2, the shoulder part 3, and the opening part 4 are consecutively formed in this order, at a position where the respective central axes of the parts are matched on a common axis line. Additionally, the body part 2, the shoulder part 3, and the opening part 4 each have a circular shape in cross section, and the common axis line is a line passing through a central part of the circular shape of this cross section. Hereinafter, this common axis line is referred to as a central axis line O.

To this body part 2, the panels 11 (for example, six) are formed at intervals along a circumferential direction of the body part 2. Additionally, a space between the panels 11 adjacent in the circumferential direction of the body part 2 serves as a column 12. In other words, in the body part 2, the panels 11 and the column 12 are alternately formed along the circumferential direction of the body part 2. Additionally, the length of the column 12 in the central axis line O is equal to that of the panel 11.

The panels 11 are formed so as to be recessed inwardly in a radial direction of the body part 2, and are formed in a substantially rectangular shape as viewed laterally. Additionally, the panel 11 has a central panel face 15, and an inclined face 16 surrounding the central panel face 15.

The central panel face 15 is formed in a substantially rectangular shape in a lateral view thereof. Additionally, toward a central part of the central panel face 15, the amount of its recession directing inwardly in the radial direction of the body part 2 increases.

The inclined face 16 is formed in a substantially rectangular shape in a lateral view, and each corner part of the inclined face is formed in an arcuate shape as a curved part 17. Additionally, in the inclined face 16, from the outside of the panel 11 toward the outer edge of the central panel face 15, the amount of recession inwardly in the radial direction of the body part 2 increases.

Figure 2:
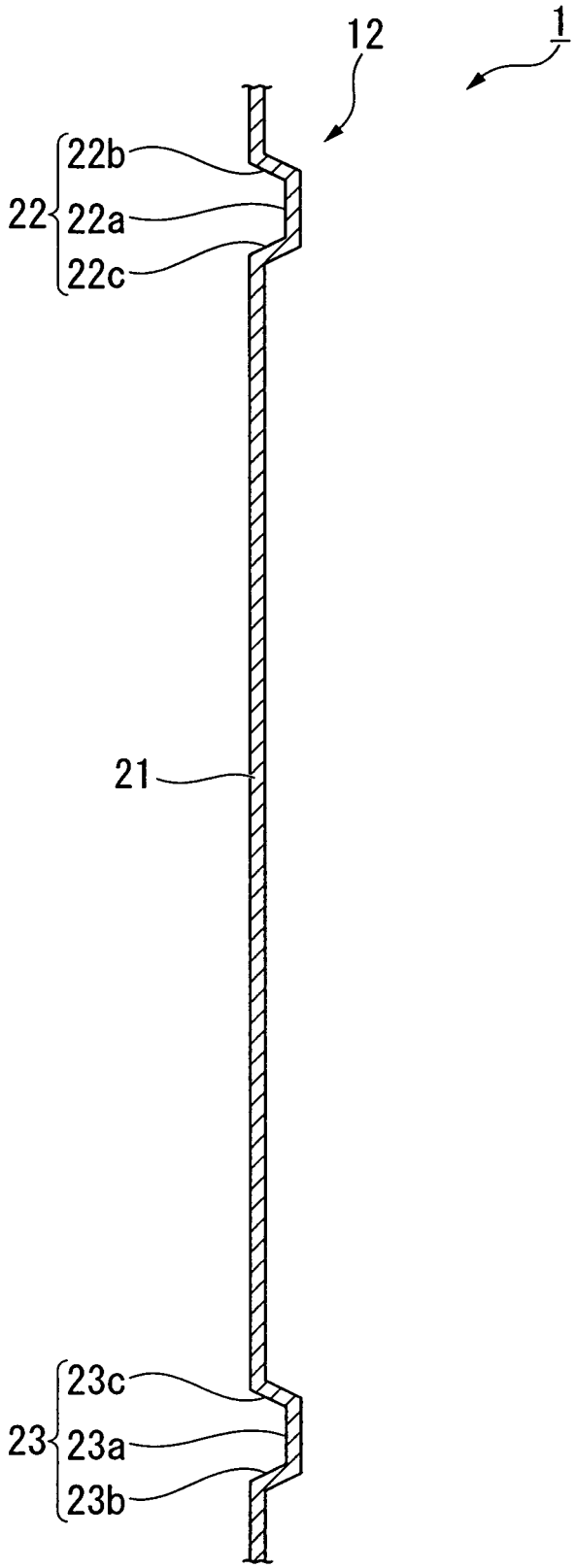
FIG. 2 is a partially sectional view illustrating a column in FIG. 1.

As shown in FIGS. 1 and 2, the column 12 has a column body 21, and grooves 22, 23 formed at an upper and lower ends of the column 12.

Since a corner part of the inclined face 16 of each of the adjacent two panels 11 is curved 1, the end edge of the column body 21 along the circumferential direction is curved such that its width in the circumferential direction narrows towards a central portion thereof along the central axis O direction.

Each of the grooves 22, 23 is formed such that it extends along the circumferential direction of the body part 2, and both end portions of each of the grooves 22, 23 in the circumferential direction are in contact with both end edges of the column 12 in the circumferential direction. In other words, each of the grooves 22, 23 is not formed such that it reaches the inside of the panel 11. Additionally, each of the grooves 22, 23 has the amount of recession (depth) in the radial direction of the body part 2 in the range of, for example, 0.3 mm to 1 mm, and the width along the central axis direction O in the range of, for example, 1 mm to 5 mm.

As shown in FIG. 2, the groove 22 has a bottom part 22*a*, and inclined parts 22*b*, 22*c*. The inclined parts 22*b*, 22*c* are formed on the upper and lower side of the bottom part 22*a*, respectively, and the amount of recession (depth) inwardly in the radial direction decreases as each of the inclined parts extends away from the bottom part 22*a*. Additionally, the upper edge of the groove part 22 is formed at the same position as the upper edge of the panel 11 in the central axis O direction.

Additionally, similar to the groove 22, the groove 23 has a bottom part 23*a*, and inclined parts 22*b*, 22*c*. Similar to the groove 22, the inclined parts 23*b*, 23*c* are formed on the upper and lower sides of the bottom part 23*a*, respectively, and the amount of recession (depth) inwardly in the radial direction decreases as each of the inclined parts extends away from the bottom part 23*a*. Additionally, the lower edge of the groove 23 is formed at the same position as the lower edge of the panel 11 with respect to the central axis O direction.

As shown in FIG. 1, a shoulder part 3 is formed such that it seamlessly connects with the upper edge of the body part 2, and the diameter of the shoulder part gradually decreases towards the upper portion from the upper edge of the body part 2.

An opening part 4 is formed such that it seamlessly connects with the upper edge of the shoulder part 3, and a male thread part 25 is formed on the outer circumferential face thereof so that a cap (not shown) can be freely attached or detached thereto.

When the bottle 1 described above is filled with high temperature contents, the panels 11 of the bottle 1 deform and expand outwardly in the radial direction of the body part 2. Additionally, when the contents are cooled and the inside of the bottle is depressurized in a state where the cap is screwed to the opening part 4 of the bottle 1, the panel 11 deforms to be collapsed. As described above, both ends of each of the grooves 22, 23 in the circumferential direction are in contact with both circumferential edges of the column 12, and the grooves are not formed within the panel 11. Thus, each of the grooves 22, 23 is less likely to follow the swelling deformation or collapsed deformation of the panel 11, and the appearance of the bottle can be maintained.

According to the bottle 1 described above, by the grooves 22, 23 formed at both upper and lower ends of the column 12, occurrence of local deformation at the column 12 can be suppressed.

Additionally, since the grooves 22, 23 are formed at the upper and lower end portions of the column 12 throughout its entire length in the circumferential direction, resistance to the deformation of the column 12 can be sufficiently increased. Thus, since swelling deformation or collapsed deformation of the body part 2 is reliably prevented when the bottle is filled with high temperature contents or the inside of the bottle is depressurized, the width in the circumferential direction of the column 12 can be reduced and the panel 11 can be enlarged.

Additionally, since both end portions of each of the grooves 22, 23 are in contact with both circumferential edges in the circumferential direction of the column 12, the deformation of the grooves 22, 23 in the radial direction accompanying the deformation in the radial direction of the panel 11 can be prevented. Therefore, the appearance of the bottle 1 can be maintained.

Furthermore, by forming the inclined parts 22*b*, 22*c*, 23*b*, 23*c* in each of the grooves 22, 23, the die cutting at the time of molding the bottle 1 becomes easy.

It should be noted that the present invention is not limited to the embodiment as described above, and various modification may be applied, provided that such modification is made within the scope of the present invention.

For example, although the grooves are formed at both the upper and lower ends of the column, it may be sufficient to form the groove at any one of the upper and the lower ends.

Additionally, when the groove is formed at any one of the upper and lower ends of the column, it is preferable to form the groove at the lower end of the column. In general, the lower end of the bottle is more likely to be formed thinner as compared with the upper end. Thus, by forming the groove at the lower end portion of the column, local deformation of the column can be reliably prevented.

Additionally, the groove is formed such that the upper end or lower end of the groove is connected to the upper end or lower end of the panel seamlessly in the circumferential direction. However, the groove may be formed at another location, provided that the location is at the end portion of the column.

Additionally, although the groove has the inclined part, it may be possible to employ a configuration in which no inclined part is formed.

Additionally, the shape of the panel as viewed laterally is not limited to that of a rectangle, and another shape may be employed.

Additionally, it may be possible to form the groove so as to have a substantially constant depth, or to form the groove so as to increase the depth towards the central part in the circumferential direction.

INDUSTRIAL APPLICABILITY

According to the bottle of the present invention, the column with the groove is less likely to deform in the radial direction. Therefore, the occurrence of the local deformation of the column can be suppressed. Additionally, the groove is not formed such that it reaches the inside of the panels, whereby the deformation of the groove accompanying the deformation of the panels can be prevented.

The invention claimed is:

1. A bottle comprising:

a tubular body that is formed so as to extend in a central axis direction thereof, the tubular body having a bottom;

a plurality of panels recessed inwardly in a radial direction of the tubular body, the panels being formed at intervals in a circumferential direction of the tubular body; and a column formed by a space provided between a first panel and a second panel of the panels adjacent to each other in the circumferential direction, the column being formed to be surrounded by two first-end edges of the column which face each other in the central axis direction and two second-end edges of the column which face each other in the circumferential direction, the two first-end edges being in contact with two third-end edges of the first panel which face each other in the central axis direction and two fourth-end edges of the second panel which face each other in the central axis direction, the two second-end edges being in contact with one of two fifth-end edges of the first panel which face each other in the circumferential direction and one of two sixth-end edges of the second panel which face each other in the circumferential direction, the one of two fifth-end edges and the one of two sixth-end edges facing each other in the circumferential direction, and the column includes:

a column body which is formed so as to extend in the circumferential direction from the one of two fifth-end edges to the one of two sixth-end edges;

a first groove which is formed so as to be recessed on an outer surface of the column body and extend in the circumferential direction from the one of two fifth-end edges to the one of two sixth-end edges while being in contact with the column body in the central axis direction, wherein the first groove has a bottom part and two inclined portions, the two inclined portions of the first groove being formed so as to extend from both end portions of the bottom part of the first groove in the central axis direction, and the first groove is formed on an upper end of the column, and a second groove which is formed so as to be recessed on the outer surface of the column body and extend in the circumferential direction from the one of two fifth-end edges to the one of two sixth-end edges while being in contact with the column body in the central axis direction, wherein second groove has a bottom part and two inclined portions, the two inclined portions of the second groove being formed so as to extend from both end portions of the bottom part of the second groove in the central axis direction, and the second groove is formed on an lower end of the column, wherein the column body has a smooth outer surface between the one of two fifth-end edges to the one of two sixth-end edges and between a lower inclined portion of the two inclined portions of the first groove and an upper inclined portion of the two inclined portions of the second groove.

2. The bottle according to claim 1, wherein upper edge of the first groove is formed at the same position as a first-upper-end edge of the two third-end edges and a second-upper-end edge of the two fourth-end edges in the central axis direction, or is formed on a lower side of the first-upper-end edge and the second-upper-end edge, and a lower edge of the second groove is formed at the same position as a first-lower-end edge of the two third-end edges and a second-lower-end edge of the two fourth-end edges in the central axis direction, or is formed on an upper side of the first-lower-end edge and the second-lower-end edge.

* * * * *